United States Patent [19]

Stuckenbrok et al.

[11] 4,355,603

[45] Oct. 26, 1982

[54] INTERNAL COMBUSTION ENGINE

[76] Inventors: Freder Stuckenbrok, Roennelstrasse 87, 2933 Jade 2; August Stuckenbrok, Gewerbegehiet, 2948 1 Schortens, both of Fed. Rep. of Germany

[21] Appl. No.: 116,063

[22] Filed: Jan. 28, 1980

[30] Foreign Application Priority Data

Mar. 13, 1979 [DE] Fed. Rep. of Germany ..... 2909715

[51] Int. Cl.[3] ..... F02B 53/00

[52] U.S. Cl. ..... 123/18 R

[58] Field of Search ..... 123/18 R; 417/481, 482, 417/483, 484; 91/339

[56] References Cited

U.S. PATENT DOCUMENTS

| | | | |
|---|---|---|---|
| 1,623,378 | 4/1927 | Bavington | 418/142 X |
| 2,151,848 | 3/1939 | Grunert | 417/484 |
| 2,324,023 | 7/1943 | Rappl et al. | 417/484 |

FOREIGN PATENT DOCUMENTS

| | | | |
|---|---|---|---|
| 161083 | 6/1905 | Fed. Rep. of Germany | 123/18 R |
| 1000029 | 1/1957 | Fed. Rep. of Germany . | |
| 7104235 | 4/1972 | Fed. Rep. of Germany . | |
| 2735725 | 2/1979 | Fed. Rep. of Germany | 123/18 R |
| 2802123 | 7/1979 | Fed. Rep. of Germany | 123/18 R |
| 447632 | 11/1912 | France | 123/18 R |
| 30582 | 5/1955 | Switzerland | 123/18 R |
| 1511654 | 5/1978 | United Kingdom . | |

*Primary Examiner*—Michael Koczo, Jr.

*Attorney, Agent, or Firm*—Beveridge, DeGrandi & Kline

[57] ABSTRACT

An internal combustion engine of the type having a chamber generally resembling that of a rotary engine. The piston means is of the type of a pendulum-like oscillating piston whose sides cooperate with two generally opposite combustion chambers. The piston has generally flat faces perpendicular to the axis of oscillation, sealing by engaging respective ends of the engine block chamber in which are suitably disposed ports for introduction of fuel mixture into the combustion chambers. The oscillations of the piston are transformed to the rotation of an output shaft by a slider reciprocating within the piston and mounted on an eccentric fixedly secured to the output shaft. The slider also assists in charging fuel mixture into the combustion chambers.

6 Claims, 5 Drawing Figures

INTERNAL COMBUSTION ENGINE

BACKGROUND OF THE INVENTION

The invention relates to an internal combustion engine with generally disc-shaped piston means which is sealed at its circumference and its faces, the piston means being movably arranged in a chamber or cavity of an engine block so as to drive a shaft while a part of the circumference of the piston means defines with a portion of the cavity, combustion chambers whose size varies as the piston means moves within the cavity.

In a broad sense, the invention belongs to the art similar to the known, so-called rotary engines, wherein the chamber in the engine block houses a rotary piston means. The chamber has a complex peripheral contour of the shape of several overlapping circular arcs, while the rotary piston has the general shape of a distorted triangle with rounded sides. Due to the complex outer contour of the chamber, the rotary piston has to be moved along a path securing that the sealing means located at its corners are in a continuous contact with the inner wall of the chamber thereby forming, with the wall and with the respective sections of the piston, combustion chambers of continuously varying volume. In such an engine, reaction forces are developed at different phases of rotation, which can amount to about 50% of the actual drive force so that the engine uses a relatively large amount of fuel. A further disadvantage of this known engine is in that the seals located at the corners of the rotary piston have to be rounded because of the path along which they have to pass and, therefore, have only a line contact with the sealing surface which gives rise to considerable sealing problems in practice. Furthermore, a special gearing is required for transmitting the complex movement of the rotary piston to a plain rotation of the output shaft of the engine.

On the other hand, small size and the resulting favorable weight-to-output ratio of these engines presents advantage over classical piston engines.

SUMMARY OF THE INVENTION

It is an object of the present invention to provide an improved engine broadly belonging to the above type but being of a considerably simpler structure, having an improved efficiency and reducing the problem of sealing the piston within the engine block housing.

In general term, the present invention provides an internal combustion engine including piston means of the type having a convexyl rounded peripheral portion and two generally flat face portions spaced from and generally parallel with each other and generally perpendicular to said rounded peripheral portion, said piston means being arranged for movement within a housing formed in an engine block; said piston means including first seal means slidably engaging a part of an interior wall of said housing to thus define therewith combustion chamber means limited by a part of said peripheral portion; said piston means being arranged for oscillating movement about a first axis generally perpendicular to said face portions, disposed adjacent a section of said peripheral portion and arranged near a section of interior wall portion of said housing; said piston means having an elongate slot open at both face portions of the piston means, said slot having two straight, parallel side walls generally perpendicular to said face portions, and two end walls, one disposed near the first axis, the other remote from said first axis; slide means disposed for reciprocating movement within said slot between said end walls; second seal means operatively associated with said slide means, with said piston means and with said housing to define a charging chamber at each end of the slot, each charging chamber being limited by said second seal means, by respective portions of said side walls of the slot, by a respective end wall of the slide and by adjacent part of the interior wall portion of said housing; output shaft means parallel with said first axis and including an eccentric rotatably engaging said slide means, whereby the combination of said oscillating movement of said piston means and of said reciprocating movement of said slide means is transformed into rotary movement of said output shaft means; fuel mixture feeding means for feeding fuel mixture into said combustion chamber means; fuel ignition means for selectively igniting said fuel mixture in said combustion chamber means; and exhaust means for releasing exhaust gas from said combustion chamber means.

According to another feature of the present invention, the exhaust means includes an exhaust orifice in said housing, disposed at a portion thereof generally opposite to the location of said first axis.

According to a still another feature of the present invention, said rounded peripheral portion is defined by a contour formed of three arc sections of which a first arc section is disposed near said exhaust orifice and has a radical centre coincident with said first axis, said first circular arc adjoining, at each end thereof, a second arc section and a third arc section, respectively, said second and third arc sections extending from the respective end of the first arc section to a joinder of the second and third arc sections near said first axis; the second and third arc sections being each coincident with the respective portions of said piston means defining said combustion chamber means, a major section of that respective part of the interior wall portion of said housing, which defines the respective combustion chamber means, being of the shape generally identical to that of the respective second and third arc section.

In accordance with a still further feature of the present invention, the first seal means includes: axial, generally straight sealing members extending axially of said piston means and generally coincident with joinders between said first arc section and the second and third arc sections, respectively; an apex sealing member generally parallel with said axial sealing member and engaging the interior or said chamber near said first axis; arcuate sealing members in the respective face portions and sealingly engaging generally flat end wall portion of the interior of said housing, said arcuate sealing members being closely spaced from and generally parallel with the respective first, second and third arcuate sections and sealingly engaging said axial and apex sealing members at respective joinders therewith.

In accordance with yet a further feature of the present invention, the fuel mixture feeding means includes channel means having port means coincident with at least one of said end wall portions of the interior of said housing, said port means being disposed such as to being alternatively closed by said slider means and/or by said piston means and open for communication with said slot; and second channel means having port means in at least one of said end wall portions of the interior of said housing, the port means of said second channel means being also arranged to become alternatively closed and open by said piston means and/or slide means for selective opening and closing of a communication between said slot and said combustion chamber means.

The sealing means preferably includes sealing lips of a generally rectangular cross-sectional contour. In a preferred embodiment, the eccentric is a disc fixedly secured to said output shaft and rotatable in roller bearing means disposed in said slide means.

BRIEF DESCRIPTION OF THE DRAWINGS

The drawings show one embodiment of the internal combustion engine according to the present invention. In particular.

DESCRIPTION OF PREFERRED EMBODIMENT

Figure 1:
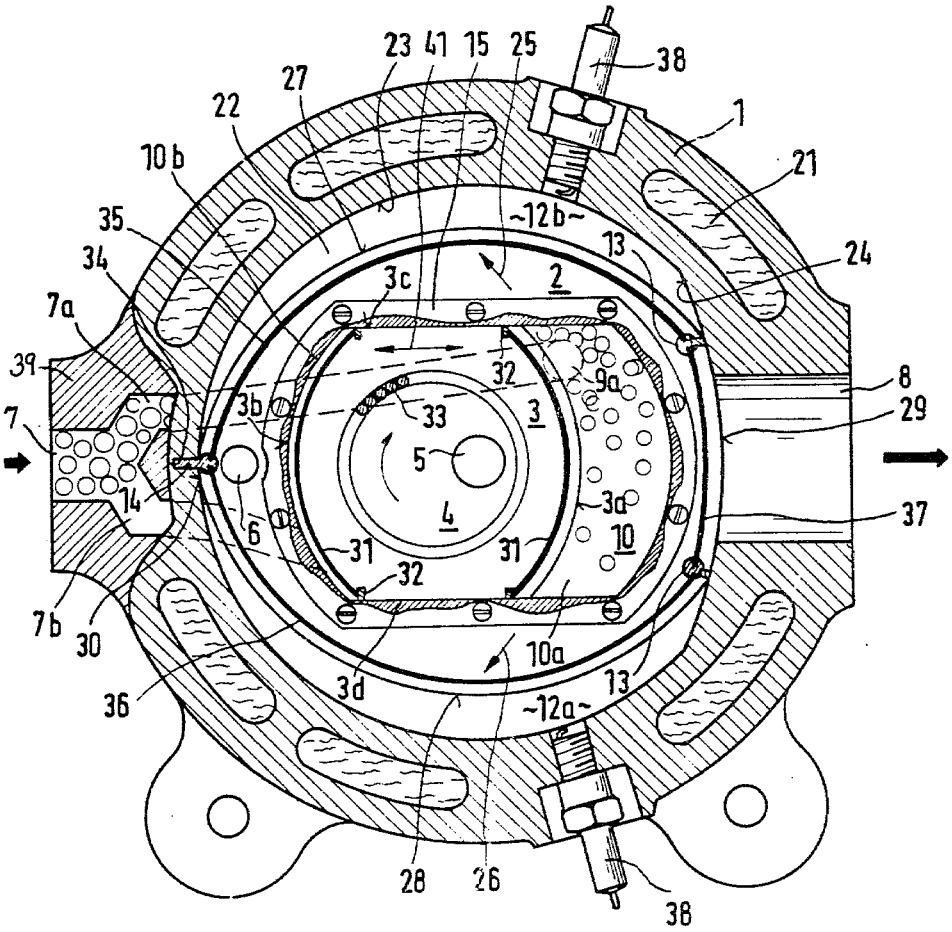
FIG. 1 is a cross-section of the chamber of an engine block with the piston means situated in a central position, at which fuel mixture has been drawn into the right-hand chamber in the slot located in the piston.
Figure 2:
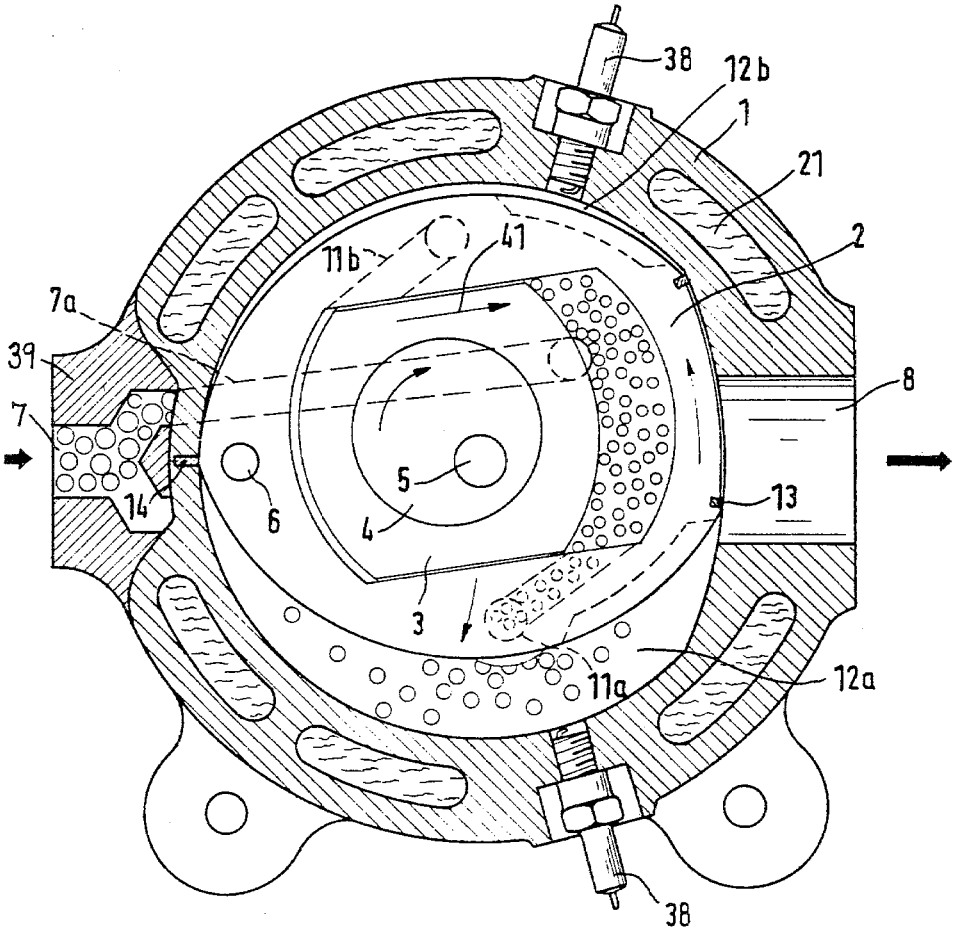
FIG. 2 is a cross-section similar to that in FIG. 1, wherein the piston is disposed at uppermost position and the fuel mixture charged into the combustion chamber located under the piston, as viewed in that figure.
Figure 3:
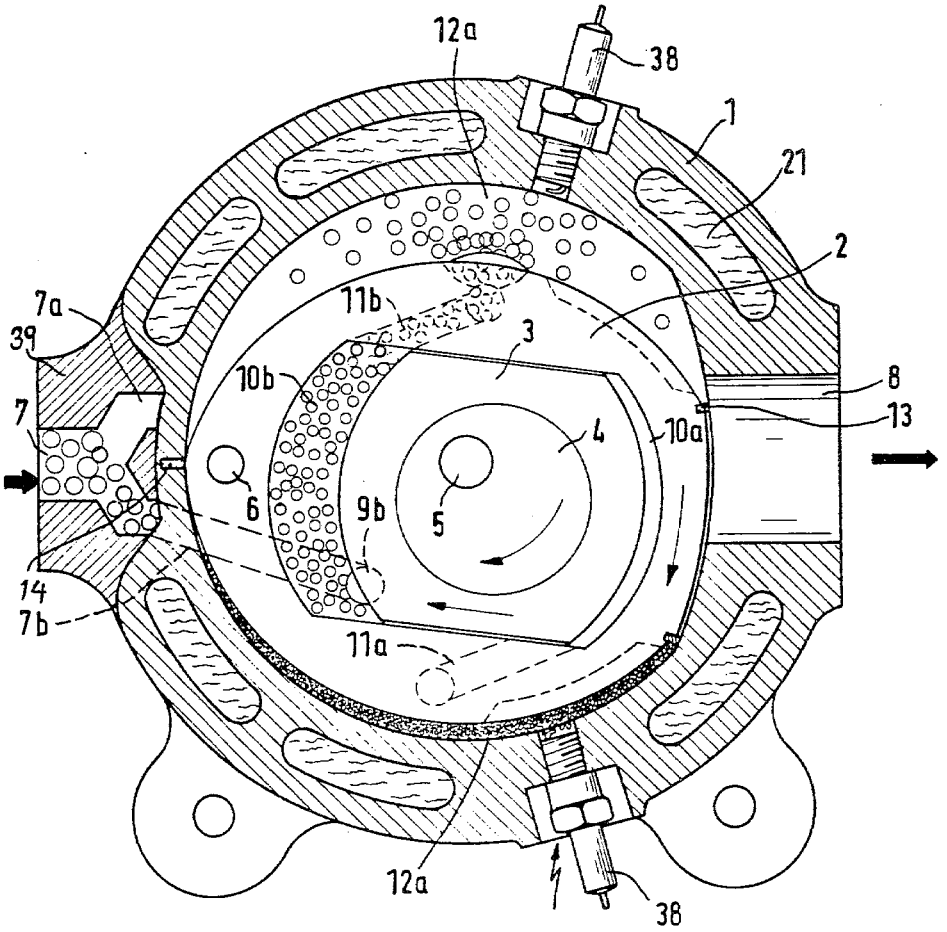
FIG. 3 is a cross-sectional view similar to that in FIGS. 1 and 2 at the moment of ignition of the fuel mixture compressed in the lower combustion chamber as viewed in that figure.

The swinging piston engine has an engine block 1 having a generally circular outer contour with cooling water channels 21 in its wall. It contains a central chamber or housing 22 with a generally circular or cylindric inner wall 23, the circular contour being distorted at a concavely curved portion 24 in the area of exhaust channel 8. The radius of curvature of the portion 24 is greater than that of the inner wall 23.

In the chamber 22 is disposed a generally disc-shaped piston 2, also referred to as "piston means". The piston 2 can oscillate or swing back-and-forth according to arrows 25 and 26, about a pivot 6. Its movement can thus be referred to as an oscillating movement about a first axis, the first axis being defined by said pivot 6. The piston 2 has an outer contour formed by three portions 27, 28 and 29 of which portions 27 and 28 are each circular arc sections curved at the same radius as the inner wall 23 of chamber 22, and joined at a joinder 30, while the portion 29 is an arc section parallel to the portion 24 of chamber 22 and thus is curved at a radius whose centre is coincident with the first axis or with the axis of the pivot 6.

In a slot 10 of piston 2, a slider 3 (also referred to as "slide means") is situated for reciprocating in the direction of double arrow 41, parallel with straight side walls of the slot 10. Accordingly, depending on the position of piston 2, there are chambers **10*a* and 10*b*, respectively, in front of the two rounded ends 3*a* and 3*b* of the slider 3**, at the concave end walls of the slot.

Slider 3 contains in its face portions and in its upper and lower guide surfaces **3*c* and 3*b* lip seals 31 and 32 which are in contact with the generally flat inner surface of cover plates 15 which limit chambers 10*a*, 10*b*** at the face portions thereof.

In the slider 3 is mounted an eccentric 4 on rollers 33 so that the eccentric 4 can rotate relative to the slider 3. The eccentric is fixedly secured to a drive or output shaft 5.

The piston 2 contains in its portion 29 two lip seals 13 which extend parallel to each other over the depth or thickness of the piston, and in the area of its tip 30 another equally long lip seal 14 is arranged, the latter interlocking with a groove 34 in the inside wall of the engine block 1. Seals 13 and 14 are also referred to as "first seal means". In the faces of piston 2 further lip seals 35, 36 and 37, extending parallel to its outer contour are disposed. They cooperate with generally planar face walls of chamber 22 (the face walls not being shown in the drawings).

Above and below piston 2, as viewed in FIG. 1, one combustion chamber **12*a* and 12*b*, respectively, is provided, each having a spark plug 38**.

A connecting piece 39 at the left of FIG. 1 contains a suction channel 7 for fuel mixture. This suction channel 7 branches into two channel portions **7*a* and 7*b* inside the connecting piece 39, which, in turn, communicate at respective ports 9*a*, 9*b* in the face wall or a partition of the engine block, each with one of the chambers 10*a*, 10*b* of the slot 10 in which the slider 3 reciprocates. Thus, depending on the instant position of piston 2 and slider 3, fresh fuel mixture can be drawn into one of the two chambers 10*a* and 10*b*, through the channels 9*a* or 9*b***.

The chambers **10*a*, 10*b* communicate with the respective combustion chambers 12*a*, 12*b*, by transfer channels 11*a* and 11*b*. The inlet ports of the said channels within the housing are so disposed that, depending on the instant position of piston 2, while one end of the slider 3 charges fresh fuel mixture into the respective combustion chamber, the opposite end draws fresh mixture into the respective chamber of the slot 10**.

Piston 2 may have recesses **16*a* and 16*b*, respectively, in each of portions 27 and 28**.

OPERATION

Figure 4:
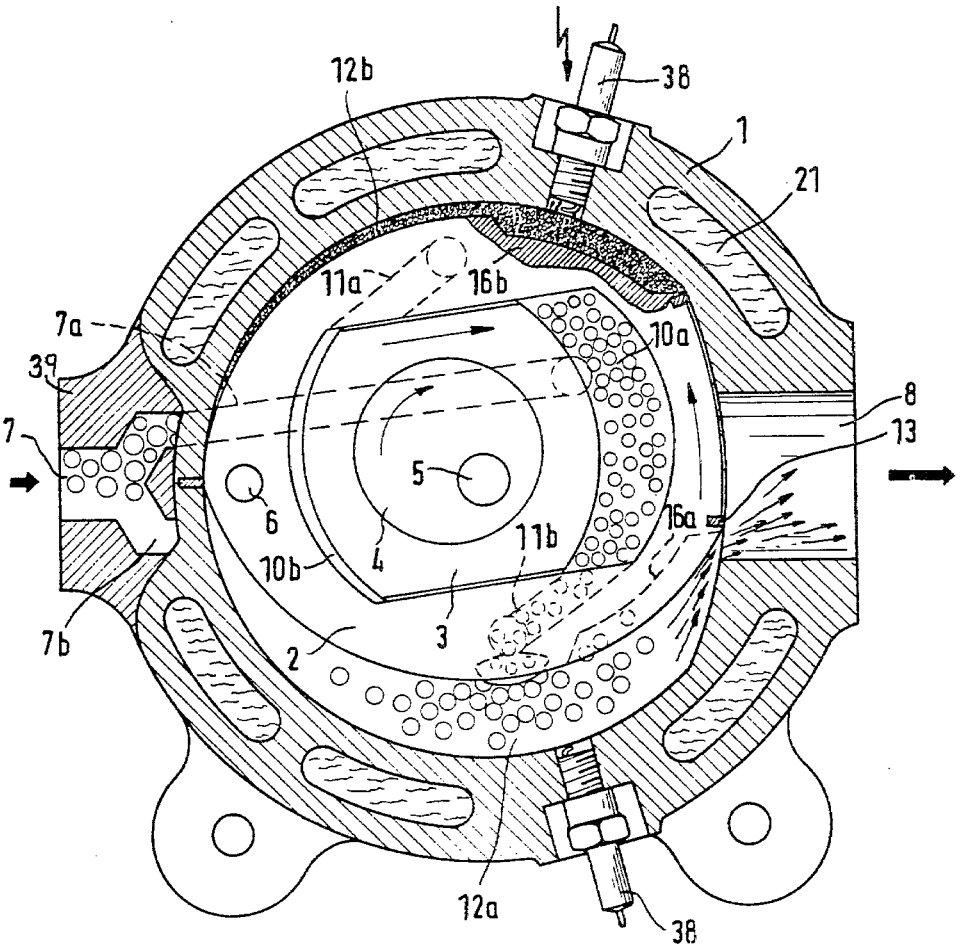
FIG. 4 is a yet another cross-sectional view showing the phase after the fuel mixture ignited in the lower combustion chamber has expanded and moved the piston into the opposite position wherein the fuel mixture in the upper combustion chamber has been compressed and is being ignited.

It is apparent that if shaft 5 rotates, the eccentric 4 fixed on it causes reciprocating movement of the slider 3 along a straight line, as well as an oscillating or pendulum movement of piston means 2. The respective vacuum and compression in chambers **10*a*, 10*b* caused by the movement of the slider 3 in slot 10 is used for drawing the fuel mixture into one of the chamber 10*a*, 10*b* and for simultaneous injection of same from the other into the respective one of the two combustion chambers 12*a* and 12*b*. The swinging or oscillating movement of piston 2 results in compression of the fuel mixture in the respective combustion chamber, until same is ready to become ignited at the extreme position of piston 2 (FIG. 4). At the same time, the already ignited and spent mixture in the opposite chamber 12*a* escapes through exhaust 8 whose upstream portion now communicates with chamber 12*a* due to the instant position of piston 2. The discharge of the exhaust gas is assisted by the flushing effect of the fresh fuel mixture coming from chamber 10*a* via channel 11*b*, as shown in FIG. 4. In order to draw fresh fuel mixture into the respective chamber 10*a*, 10*b*, the ports 9*a* and 9*b* of branch channels 7*a* and 7*b* are alternatively opened and closed by the slider 3 so that each of the ports is only open at the respective suction phase. In the same way, the transfer ports 11*a*** and 11*b* which communicate the respective chamber 10*a*, 10*b* with the respective combustion chamber 12*a* and 12*b*, are opened and closed depending on instant positions during the swinging movements of piston 2, to discharge fresh fuel mixture out of the respective chamber 10*a* or 10*b* into the respective one of the combustion chambers while the charged combustion chamber is in an expanding state.

The engine block 1 can be arranged so that the exhaust channel 8 points downward. Such a layout is of advanage for use in motor vehicles because both spark plugs are then easily accessible and the carburetor, which is not shown here, can be situated above the engine block.

Figure 5:
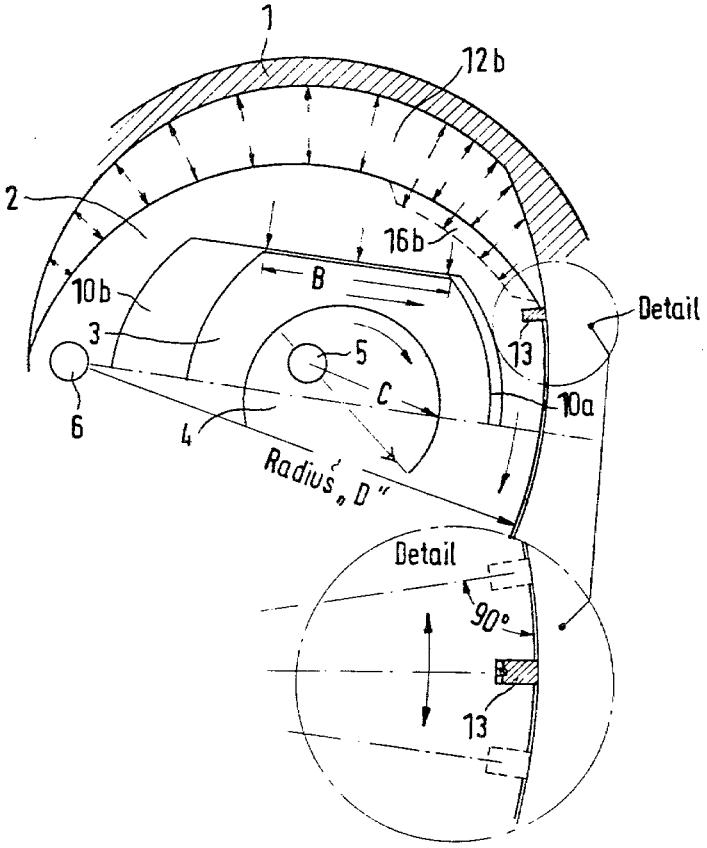
FIG. 5 is a diagram of the mode of operation of the engine with a detail showing how the front side seal of the piston fits on the sealing surface.

Advangages of the oscillating piston engine will be appreciated particularly on review of FIG. 5.

The engine has a simple construction because it has only three movable parts, namely piston 2, slider 3 and shaft 5 with the eccentric 4 attached to same. However, any number of such basic engine elements can be arranged parallel to each other and in space-saving, lightweight arrangement, whereby a plurality of basic engine units would have a common output shaft 5 with one eccentric for each basic engine unit wherein the eccentrics of adjacent units would be displaced at an angle of 180° relative to each other. Instead of or additionally to the staggered arrangement of the eccentric discs, counterweights can be provided. The pivot 6 of all pistons 2 of an aggregation can be aligned in such a way, that one pivot means, e.g. a single rod, can be used. The width of the piston and/or the diameter of chamber 22 is decisive for the displacement volume.

It can be seen from FIG. 5 that the explosion pressure generated in combustion chambers 12*a* and 12*b* is transferred via area B of slider 3 to the eccentric 4 to become transmitted into rotary motion of the output shaft 5. Since each piston 2 extends from its pivot 6 over and beyond the shaft 5, the piston acts as a lever.

Since the piston 2 only makes oscillating pendulum movements, the seals 13, 35, 36 and 37 always move over the same surfaces so that even when light damages should occur, they can grind themselves back into shape. The seals can be of a generally rectangular cross-sectional configuration thus considerably reducing the problems due to the round cross-section required in rotary engines.

The described swinging or oscillating piston engine works with high degree of efficiency and thus very economically. Furthermore, the engine has an extended operation life due to the simplicity in structure, the arrangement of the seals and the low friction and is, furthermore, relatively inexpensive to produce. It combines many advantages of the known rotary disc engines without having their disadvantages such as high reaction forces, sensitive seals, starting difficulties and so on.

Those skilled in the art will readily appreciate that many modifications of the described embodiment can be provided without departing from the scope of the present invention as set forth in the accompanying claims.

We claim:

1. Internal combustion engine including piston means of the type having a convexly rounded peripheral portion and two generally flat face portions spaced from and generally parallel with each other and generally perpendicular to said rounded peripheral portion;

(a) said piston means being arranged for movement within a housing formed in an engine block;

(b) said piston means including first seal means slidably engaging a part of an interior wall of said housing to thus define therewith combustion chamber means limited by a part of said peripheral portion;

(c) said piston means being arranged for oscillating movement about a first axis generally perpendicular to said face portions, disposed adjacent a section of said peripheral portion and arranged near a section of interior wall portion of said housing;

(d) said piston means having an elongate slot open at both face portions of the piston means, said slot having two straight, parallel side walls generally perpendicular to said face portions, and two end walls, one disposed near the first axis, the other remote from said first axis;

(e) slide means disposed for reciprocating movement within said slot between said end walls;

(f) second seal means operatively associated with said slide means, with said piston means and with said housing to define a charging chamber at each end of the slot, each charging chamber being limited by said second seal means, by respective portions of said side walls of the slot, by a respective end wall of the slide and by adjacent part of the interior wall portion of said housing;

(g) output shaft means parallel with said first axis and including an eccentric rotatably engaging said slide means, whereby the combination of said oscillating movement of said piston means and of said reciprocating movement of said slide means is transformed into rotary movement of said output shaft means;

(h) fuel mixture feeding means for feeding fuel mixture into said combustion chamber means and including first channel means having port means coincident with at least one of said end wall portions of the interior of said housing, said port means being disposed such as to be alternatively closed by said slider means or by said piston means and open for communication with the charging chamber at one end of the slot, and second channel means having port means in at least one of said end wall portions of the interior of said housing, the port means of said second channel means being arranged to become alternatively closed and open by said piston means or slide means for selective opening and closing of a communication with the charging chamber at the other end of said slot, said fuel mixture feeding means further comprising transfer channel means having inlet ports disposed such as to be alternatively closed or opened by said piston means, for interrupted communication between the charging chamber at one end of the slot with a first combustion chamber, and between the charging chamber at the other end of the slot with a second combustion chamber, said first and second combustion chambers forming said combustion chamber means and being disposed one at each of mutually opposite sections of said convexly rounded peripheral portion, whereby said piston means is driven in both directions of the oscillating movement;

(i) fuel ignition means for selectively igniting said fuel mixture in said combustion chamber means; and (j) exhaust means for releasing exhaust gas from said combustion chamber means.

2. An engine as recited in claim 1, wherein said exhaust means includes an exhaust orifice in said housing, disposed at a portion thereof generally opposite to the location of said first axis.

3. An engine as recited in claim 2 wherein said rounded peripheral portion is defined by a contour formed of three arc sections of which a first arc section is disposed near said exhaust orifice and has a radial centre coincident with said first axis, said first arc section adjoining, at each end thereof, a second arc section and a third arc section, respectively, said second and third arc sections extending from the respective end of the first arc section to a joinder of the second and third arc sections near said first axis; the second and third arc sections being each coincident with the respective portions of said piston means defining the respective combustion chambers, a major section of that respective part of the interior wall portion of said housing, which forms a part of the respective combustion chambers, being of the shape generally identical to that of the respective second and third arc section.

4. An engine as recited in claim 3, wherein said first seal means includes (a) axial, generally straight sealing members extending axially of said piston means and generally coincident with joinders between said first arc section and the second and third arc sections, respectively;

(b) an apex sealing member generally parallel with said axial sealing member and engaging the interior of said chamber near said first axis;

(c) arcuate sealing members in the respective face portions and sealingly engaging generally flat end wall portion of the interior of said housing, said arcuate sealing members being closely spaced from and generally parallel with respect to the first, second and third arcuate sections and sealingly engaging said axial and apex sealing members at respective joinders therewith.

5. An engine as recited in claims 1 or 4, wherein said sealing means includes seal lips of a generally rectangular cross-sectional contour.

6. An engine as recited in claim 1, wherein said eccentric is a disc fixedly secured to said output shaft and rotatable in roller bearing means disposed in said slide means.

* * * * *